US010814207B2

(12) United States Patent
Barber

(10) Patent No.: US 10,814,207 B2
(45) Date of Patent: Oct. 27, 2020

(54) TRAINING SPORTS BALL

(71) Applicant: Paul Steven Barber, Neath Port Talbot (GB)

(72) Inventor: Paul Steven Barber, Neath Port Talbot (GB)

(73) Assignee: Paul Steven Barber, Pantardawe, Swansea (GB)

( * ) Notice: Subject to any disclaimer, the term of this patent is extended or adjusted under 35 U.S.C. 154(b) by 0 days.

(21) Appl. No.: 15/921,307

(22) Filed: Mar. 14, 2018

(65) Prior Publication Data

US 2019/0282884 A1 Sep. 19, 2019

(51) Int. Cl.

| | |
|---|---|
| ***A63B 71/06*** | (2006.01) |
| ***A63B 43/00*** | (2006.01) |
| ***A63B 69/00*** | (2006.01) |

(52) U.S. Cl.

CPC ..... *A63B 71/0622* (2013.01); *A63B 43/002* (2013.01); *A63B 43/004* (2013.01); *A63B 69/00* (2013.01); *A63B 2071/0625* (2013.01); *A63B 2071/0655* (2013.01); *A63B 2071/0694* (2013.01); *A63B 2225/50* (2013.01); *A63B 2243/007* (2013.01)

(58) Field of Classification Search

CPC ..... A63B 71/0622; A63B 2071/0625; A63B 2071/0655; A63B 2225/50; A63B 2243/002; A63B 69/002

See application file for complete search history.

(56) References Cited

U.S. PATENT DOCUMENTS

| | | | | |
|---|---|---|---|---|
| 6,945,887 | B2 * | 9/2005 | Oister | A63B 43/00 473/570 |
| 8,730,037 | B2 * | 5/2014 | Houvener | G08B 7/06 340/517 |
| 8,858,371 | B2 * | 10/2014 | Rockoff | A63B 63/00 473/422 |
| 8,951,151 | B2 * | 2/2015 | Glowinski | A63B 43/00 273/454 |
| 9,694,248 | B2 * | 7/2017 | Monari | A63B 43/004 |
| 2013/0167290 | A1 * | 7/2013 | Ben Ezra | A63B 71/10 2/425 |
| 2014/0309059 | A1 * | 10/2014 | Minch | A63B 43/06 473/422 |

* cited by examiner

*Primary Examiner* — Joshua T Kennedy

(57) ABSTRACT

A training ball system comprising a training ball including a receiver for receiving a wireless signal from a remote location, the training ball further comprising a vibration module for providing a sensory indication to a user carrying the training ball; an input device physically separate from the training ball including a transmitter for enabling transmission of a wireless signal to the receiver; where the receiver responds to receiving a wireless signal from the input device to trigger vibration of the motor immediately upon receipt of the wireless signal.

15 Claims, 3 Drawing Sheets

TRAINING SPORTS BALL

BACKGROUND OF INVENTION

It is sometimes difficult for a sports coach to get his training drills and techniques across to the team. It is especially difficult to explain the right time to carry out a certain skill like "passing" a ball. To aid his description of what he would like his players to do and more specifically when he would like them to carry out certain actions like "passing" the ball, some help is needed.

BRIEF SUMMARY OF INVENTION

According to the present invention there is a training ball system comprising:

a training ball including a receiver for receiving a wireless signal from a remote location, the training ball further comprising a vibration module for providing a sensory indication to a user carrying the training ball; an input device physically separate from the training ball including a transmitter for enabling transmission of a wireless signal to the receiver;

the system configured such that the vibration module vibrates in response to transmission of a wireless signal from the input device to the receiver.

Vibration is through the external surface which is the user contact surface of the training ball.

The vibration module may comprise a vibration motor.

The training ball is preferably a rugby ball or an American football, however other handheld training balls are envisaged.

The coach can for example cause the sensory indication to a user through causing remote vibration of the ball. At any chosen moment the coach can command the user to "pass" the ball through the action of causing sending of a signal to effect vibration of the vibration module which in turn transmits the vibration to the carrier of the ball. The ball will be a training aid for sports coaches to instruct players in a tactile manner who are in possession of the ball when practising training drills. As such, the requirement to shout instructions which are typically not heard or are incorrectly comprehended is removed.

The input device preferably comprises a handset. The handset may sit in the palm of a user. The handset may comprise a mobile phone.

A sensory indication in the form of a vibration may be emitted upon receipt of a signal from the input device.

The user can be described as the carrier of the ball, whereas the actuator of the input device is typically a coach.

This invention relates to a sports ball (rugby football, soccer football or any sports ball) fitted with a remotely operated vibrating device either inside the ball, fitted to the outside of the ball or fitted into a separate jacket that can be put over the sports ball. The indicator arrangement can be triggered to provide a sensory indication in the form of a vibration and optionally an audible sound when instructed to by the operator (training coach) of the remote or radio-controlled handset transmitter which is synced directly to the receiver carried by the ball.

The vibration module may comprise a vibration motor. An indicator arrangement may be provided in addition to emit an audible indication. The emitter may alternatively or in addition provide an emitter for emitting a visual indication.

So, on demand, the handset operator can trigger the vibration module(s) and optionally in addition an audio speaker and therefore the ball carrier physically feels and optionally hears the sound. A typical example could be when a coach, viewing a training drill, would like the ball carrier to "pass" the ball at a specific time by pressing a button on the remote handset to physically vibrate the ball thus indicating the right time to "pass". The handset operator can also trigger the vibration/audio sound to then stop by releasing an input such as a button on the handset. The handset causes triggering of an on/off switch on a circuit board provided by the indicator arrangement which powers the vibration motor (s) and/or a speaker to cause audio sounds to be produced.

The indicator arrangement provided within the ball or in/on a jacket or sleeve for receiving the ball may comprise a battery, vibration motor, wiring harness and radio/remotely controlled switching circuit board. The circuit board may comprise a receiver which will be synced to the handset so the ball/jacket and handset are "paired".

The signal is a wireless signal. The input device is physically separate from the receiver and indicator arrangement.

The training ball preferably comprises a microcontroller powered by the battery and a motion sensor for detecting movement of the training ball, wherein the microcontroller is arranged to enter an active mode from a sleep mode upon receipt of a signal from the motion sensor representative of movement of the training ball, where in the active mode the receiver is operable to receive a signal from the input device. In the active mode the battery supplies power to the receiver such that the receiver is in an 'in use' configuration. In the sleep mode power is saved as reduced or no power is supplied to the receiver.

The input device is preferably portable, preferably handheld.

The indicator arrangement and receiver are preferably at least partially embedded in the ball. This ensures that the ball may be used normally without the indicator arrangement or receiver impeding use. The indicator arrangement and preferably the receiver may be provided between the bladder and the skin of an inflatable ball. Even more preferably the vibration module and the receiver are provided within the training ball.

It will be appreciated that the indicator arrangement and receiver may be carried by a sleeve or jacket for receipt of the ball. This means that any standard ball may be utilised without requiring modification.

The indicator arrangement and receiver may be provided within the construction material of the ball, fitted to the outside of the ball or fitted into a separate jacket that can be put over the sports ball. This device can then be triggered to vibrate and optionally release a sound or command to the person in possession of the ball by the training coach who has a remote-control handset or radio controlled handset that is "paired" to the ball. The ball/handset may also have the capability of using multiple radio frequencies, allowing multiple balls and handsets to be individually paired to each other without affecting other balls allowing multiple balls and handsets to be used at the same time within the same small area.

The training ball preferably further comprises an inlet valve for enabling air flow into the training ball, and where the vibration module and receiver are positioned diametrically opposite the inlet valve.

The invention will allow a direct link between the training coach and the ball carrier/person in possession of the ball allowing the training coach to interact and direct players from the touchline in a training session.

The invention will allow the training coach to trigger a skill at a specific moment in time without having to shout any verbal instruction from the touchline.

The invention will create direct physical and audio interaction between player and training coach making verbal drill explanations more concise and meaningful.

The invention will speed up drill explanations and therefore save time in training sessions making training sessions more productive.

The invention will create new drills not possible without the invention making teams better prepared for game situations.

The ball and handset may have the capability of utilizing multiple frequencies, allowing multiple balls to be operated within close distances of each other thus allowing multiple training sessions to happen at the same time within the same training area, without mis-instruction from neighbouring handset/coaches. The workable distance between ball and handset will have the ability to work at large ranges, typically between 1 and 100 m range from handset to ball.

According to another aspect there is a training ball carrying a vibration module for providing a sensory indication to a user carrying the training ball and a receiver for receiving a wireless signal from a remote location, whereupon in response to receipt of a wireless signal from a remote location the receiver transfers a signal to the vibration module to cause the vibration module to vibrate and provide the sensory indication to the user.

BRIEF DESCRIPTION OF THE SEVERAL VIEWS OF THE DRAWINGS

Aspects of the present invention will now be described by way of illustration only with reference to the accompany figures, where.

DETAILED DESCRIPTION OF THE INVENTION

Figure 1:
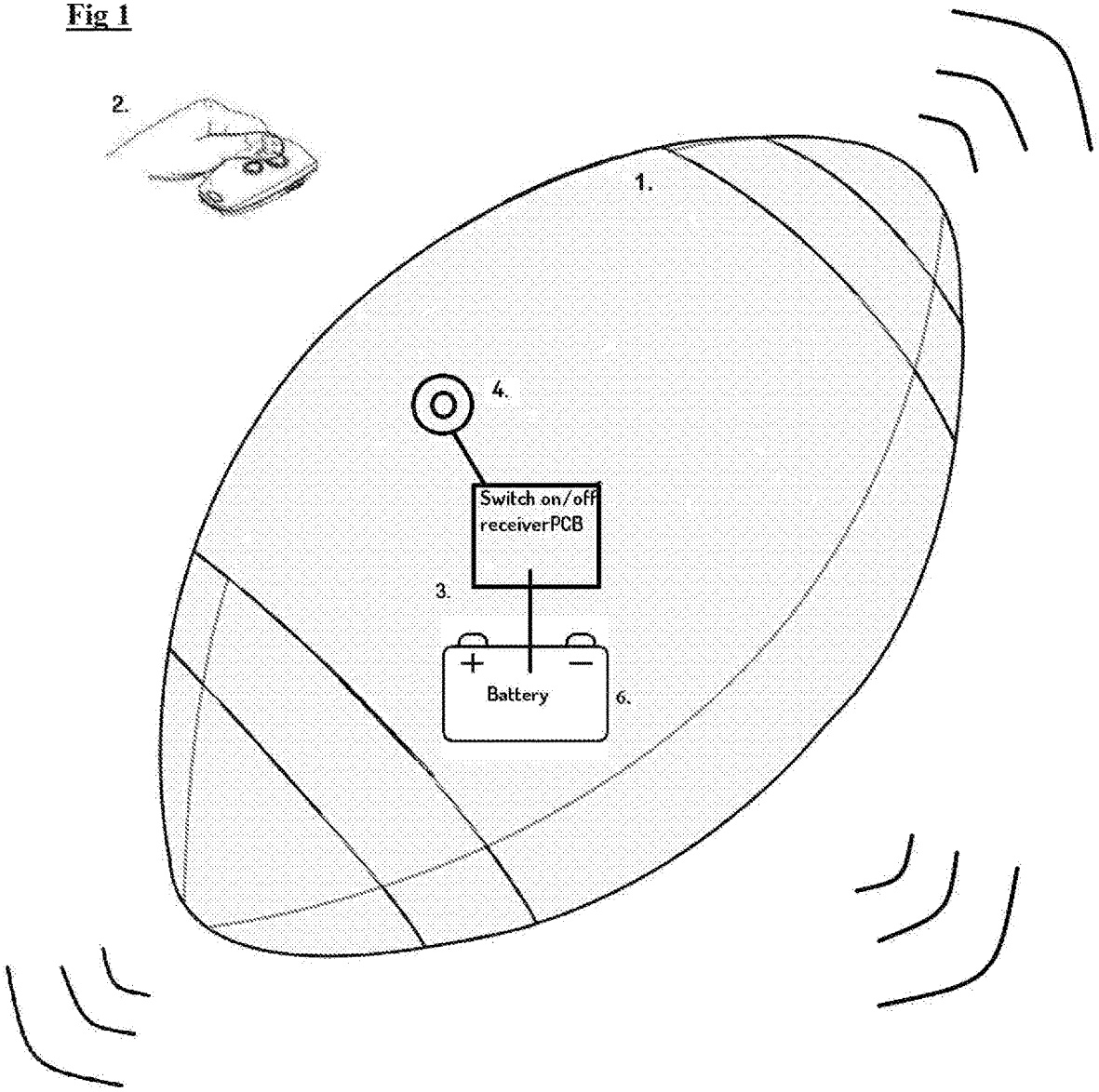
FIG. 1 is a schematic representation of an illustrative embodiment of the present invention.

According to an illustrative embodiment in FIG. 1 there is a sports ball 1 schematically represented as a rugby football. The remote handset 2 includes a power source 6 and a transmitter which when a user provides an input such as depresses a push button the transmitter is activated to transmit a signal to the receiver 3 provided on the circuit board. This signal triggers the on/off switching printed circuit board receiver 3 which in turn activates the vibration motor/multiple vibration motors 4 and optionally sound emitter 5. The ball components are powered by the battery 6. A carrier of the ball then knows that the coach is instructing the ball to be passed for example. Upon release of the push button the signal ceases to be transmitted and the vibration motor 4 stops.

The ball may comprise an on/off switch for causing the power source to be switched on such that the receiver is in a configuration capable of receipt of a signal from the input device. The on/off switch may be accessible from external of the ball.

Figure 2:
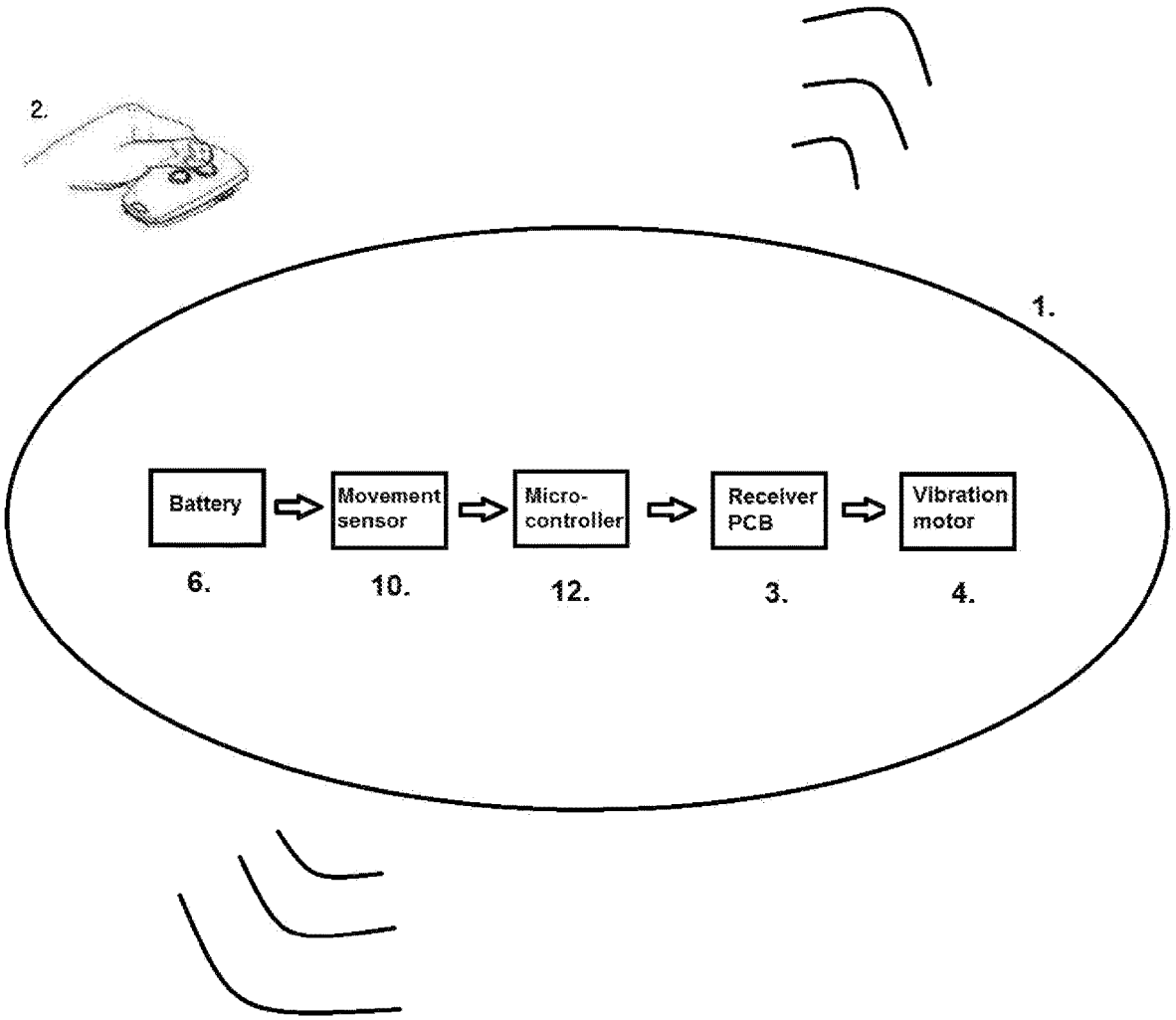
FIG. 2 is a schematic representation of a further illustrative embodiment of the present invention.

Alternatively, as represented in FIG. 2, the switching between an 'on' and 'off' configuration of the power source to the receiver may be achieved automatically without physically switching an on/off switch for example through movement of the training ball causing associated movement in a motion sensor 10. The motion sensor 10, provided in the ball 1, when activated through movement of the ball, is identified by the microcontroller 12 which then causes the microcontroller 12 to enter an 'active' mode from a 'sleep' mode meaning full power is supplied to the receiver 3 from the battery 6. This means that a signal can be received by the receiver 3 from the remote input device 2 to cause vibration of the vibration motor 4. The microcontroller may comprise a timer such that the active mode is maintained until there is no detected movement of the motion sensor for a predetermined time. After this predetermined time the microcontroller then switches off power to the receiver thereby re-entering the 'sleep' mode.

In addition, there may be a step of the microcontroller checking the battery status prior to entering the active condition to determine whether there is sufficient energy stored in the battery, and in the event of insufficient stored battery energy the active mode cannot be entered. Automatic switching between the active and sleep mode is beneficial to save battery power when not in use.

The power source can be rechargeable, either from an external port in the ball enabling a physical connection to a charger, or from wireless charging such as induction charging for example.

The above example shows all the components required to stimulate the ball and in this instance to vibrate the ball. It may be required that there are multiple vibration motors, one on every side of the ball, giving the ball carrier a complete vibration and encourage the ball carrier to always have two hands on the ball. All of the components except the remote handset 1 will be inside the training ball. The components are ideally positioned diametrically opposite to the air inlet valve which allows the ball to be inflated as this ensures that the mass of the ball is balanced. It is possible to place the components outside the rubber inflatable bladder and inside the skin of the ball effectively sandwiched between the two. This is best done at the manufacturing stage of the ball before it is sewn up. Once inflated these internal components are pressed tightly against the thick skin on the inside of the ball, this ensures a rapid response from the ball carrier after stimulation. A standard sports ball can therefore be modified to incorporate these components and create the invention and thus allowing for the invention to be easily manufactured. Alternatively, the components are positioned inside the bladder.

All the components in figures land 2 are readily available and easily accessible on the open market again enabling easy affordable manufacturing.

The workable distance between ball and handset will have the ability to work at large ranges typically between 1 and 100 m range from handset to ball. The handset to ball signal could be radio frequency (RF) or any other possible remotely operated option for example infrared.

Figure 3:
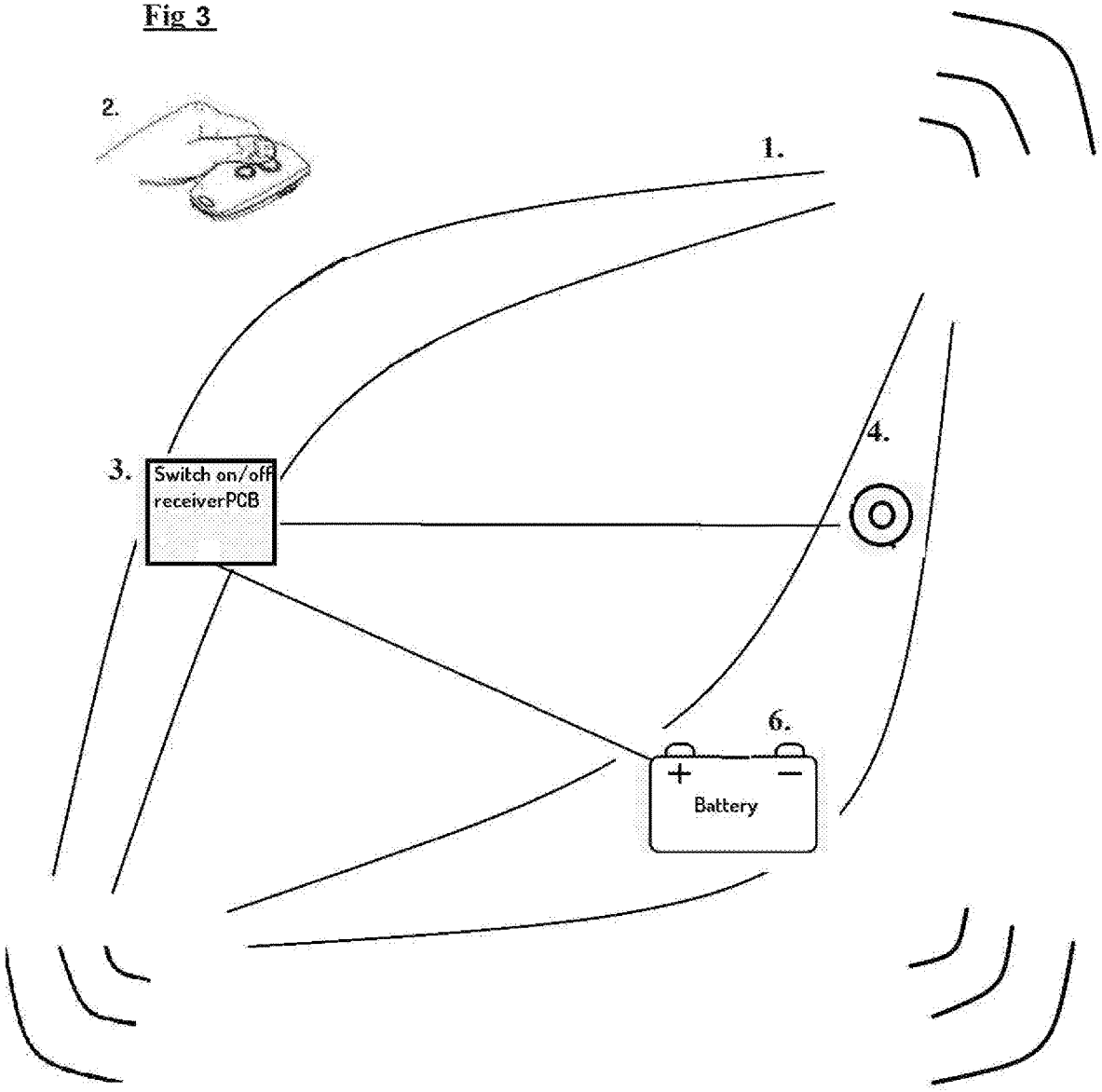

In an alternative embodiment as shown in FIG. 3 the components are fitted inside a sleeve or sock that is pulled tightly over the sports ball giving the sports ball an extra skin. This extra skin or sleeve as schematically shown in FIG. 3 contains the receiver 3 provided on the circuit board, the vibration motor/s 4, optional audio speaker 5 and battery 6. The remote handset 2 includes a power source and a transmitter which when a push button is depressed activates the transmitter to transmit a signal to the receiver 3 provided on the circuit board. This signal triggers the on/off switching printed circuit board receiver 3 which in turn activates the vibration motor/multiple motors 4 and/or audio sounds 5, all the ball components being powered by the battery 6. The carrier of the sleeved ball then knows that the coach is instructing the sleeved ball to be passed for example. Upon release of the push button the signal ceases to be transmitted and the vibration motor 4 stops.

Aspect of the invention have been described by way of example only and it will be appreciated to the skilled addressee that variations and modifications may be made without departing from the spirit and scope of the invention as afforded by the appended claims.

The invention claimed is:

1. A training ball system comprising:

a training ball including a receiver for receiving a wireless signal from a remote location, the training ball further comprising a vibration module for providing a sensory indication to a user carrying the training ball;

an input device physically separate from the training ball including a transmitter for enabling transmission of a wireless signal to the receiver;

the system configured such that the receiver responds to receiving a wireless signal from the input device to trigger vibration of the vibration motor immediately upon receipt of the wireless signal.

2. A training ball system according to claim 1 wherein the input device comprises a handset.

3. A training ball system according to claim 1 wherein the training ball is a sports ball.

4. A training ball system according to claim 1 wherein the vibration module comprises a vibration motor.

5. A training ball system according to claim 1 further comprising an emitter for providing an audible indication.

6. A training ball system according to claim 1 further comprising an emitter for emitting a visual indication.

7. A training ball system according to claim 1 wherein the vibration module is provided within the ball.

8. A training ball system according to claim 1 further comprising a battery for supplying power to the vibration module and the receiver.

9. A training ball according to claim 8 further comprising a microcontroller powered by the battery and a motion sensor for detecting movement of the training ball, wherein the microcontroller is arranged to enter an active mode from a sleep mode upon receipt of a signal from the motion sensor representative of movement of the training ball, where in the active mode the receiver is operable to receive a signal from the input device.

10. A training ball system according to claim 1 wherein the receiver is synced to the input device such that the training ball and input device are paired.

11. A training ball system according to claim 1 wherein the input device is portable and handheld.

12. A training ball system according to claim 1 wherein the vibration module and receiver are at least partially embedded in the ball.

13. A training ball according to claim 1 wherein the training ball is a handheld training ball.

14. A training ball according to claim 13 wherein the handheld training ball is an American football.

15. A training ball carrying a vibration module for providing a sensory indication to a user carrying the training ball and a receiver for receiving a wireless signal from a remote location, whereupon on receipt of a wireless signal from a remote location the receiver switches immediately from an off to an on configuration to cause the vibration module to vibrate and provide the sensory indication to the user.

* * * * *